United States Patent [19]

Stegeman et al.

[11] Patent Number: 4,995,353

[45] Date of Patent: Feb. 26, 1991

[54] VALVE TRAIN WITH LASH/COMPLIANCE COMPENSATION

[75] Inventors: George T. Stegeman, Union Lake; Tony H. Zarger, Rochester; Robert J. Outland, Grosse Pointe Woods, all of Mich.

[73] Assignee: General Motors Corporation, Detroit, Mich.

[21] Appl. No.: 508,072

[22] Filed: Apr. 11, 1990

[51] Int. Cl.[5] ..... F01L 1/14; F01L 1/24; F01L 1/08

[52] U.S. Cl. ..... 123/90.48; 123/90.55; 123/90.6; 74/567; 74/569

[58] Field of Search ..... 123/90.48, 90.49, 90.52, 123/90.55, 90.6; 74/567, 569

[56] References Cited

U.S. PATENT DOCUMENTS

| | | | |
|---|---|---|---|
| 2,272,074 | 2/1942 | Voorhies | 123/90.55 |
| 2,624,324 | 1/1953 | Russell | 123/90.6 |
| 2,668,524 | 2/1954 | Randol | 123/90.55 |
| 4,638,772 | 1/1987 | Burandt | 123/90.48 |
| 4,807,575 | 2/1989 | Litwinchuk et al. | 123/90.55 |
| 4,850,311 | 7/1989 | Sohn | 123/90.48 |
| 4,852,527 | 8/1989 | Beardmore et al. | 123/90.46 |
| 4,869,215 | 9/1989 | Parsons | 123/90.48 |

*Primary Examiner*—Charles J. Myhre
*Assistant Examiner*—Weilun Lo
*Attorney, Agent, or Firm*—Robert J. Outland

[57] ABSTRACT

Modified cams and cam followers are designed to remove lash arising from clearances and compliance in valve train components. The cam followers have a crowned cam contacting surface having a crest, and the cams have a relief formed in a part of the base circle opposite the lift profile. The relief extends across the area opposed to the crest so that the region of the relief, the cam engages the follower in a path offset from and lower than the crest. The cam regions remote from the relief contact the follower on the crest. When the cam moves from the offset contact to the crest contact the valve train will be compressed just enough to remove the compliance prior to lift profile engagement. If any lash is present, it is also removed by the same action.

12 Claims, 3 Drawing Sheets

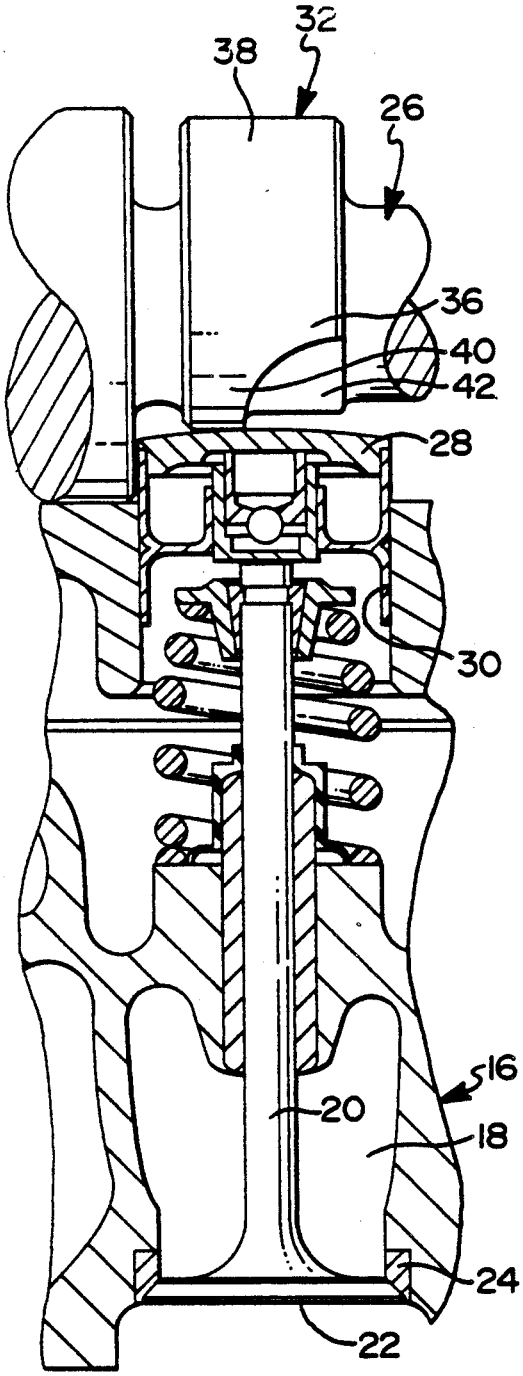
FIG 2
FIG 3
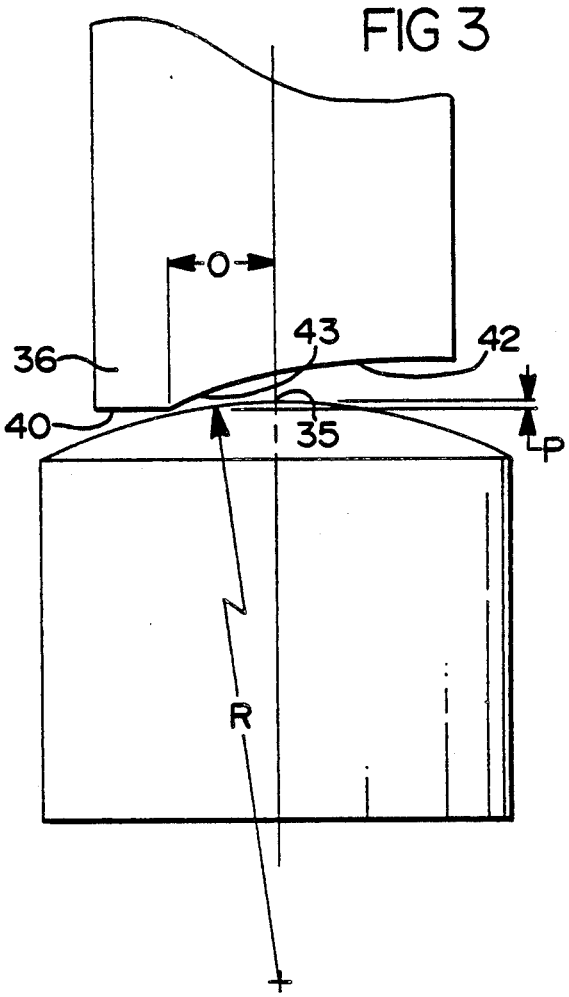
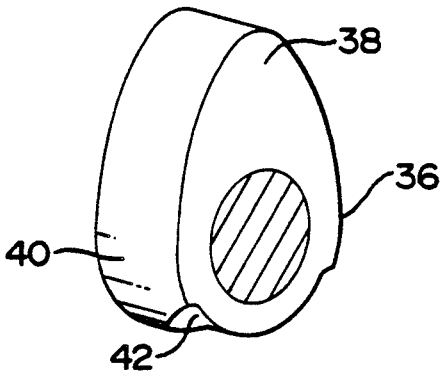
FIG 4

VALVE TRAIN WITH LASH/COMPLIANCE COMPENSATION

FIELD OF THE INVENTION

This invention relates to a valve train for an internal combustion engine and particularly to lash and/or compliance compensation in such a valve train.

BACKGROUND OF THE INVENTION

In internal combustion engines the valves are operated by cams which are coupled to the valves through a mechanism which has deflection or compliance. Direct acting valve trains comprising only a mechanical or hydraulic lifter as the coupling mechanism are quite stiff, meaning that they have little compliance. On the other hand, some valve trains employ push rods, rocker arms, etc which introduce more compliance. In addition, there can be clearance or lash between elements of a valve train when the cam is not applying a load. In any of these systems the cam quickly applies a load to the valve train which results in noise and impact force loading of the valve train. It is desirable to avoid such results by a design which preloads the valve train prior to applying the opening force to the valve so that the compliance and clearance is removed.

The U.S. Pat. No. 4,852,527 to Beardmore et al discloses a low noise valve train which proposes a particular cam design to account for valve train deflection. The design has bluff shaped pre opening and post closing ramps which respectively provide for rapid compression and relaxation of the valve train. The design results in decreased noise and impact force on the valve train, however the cam shape is complex and may be difficult to manufacture.

SUMMARY OF THE INVENTION

It is therefore an object of the invention to provide a valve train mechanism for the removal of valve train system lash or undesirable deflection prior to the designed application of opening forces using simple cams which are relatively easy to manufacture. A further object is to provide such a mechanism which allows slowly relaxing the valve train deflection upon valve closing to prevent valve bounce. It is another object to provide such a mechanism which effects rotation of the cam follower.

The invention is carried out in a valve train including a poppet valve reciprocably movable to open and closed positions and a valve spring urging the valve toward its closed position, cam means for controllably moving the valve between open and closed positions and mechanical actuating means coupling the cam means and the valve, the cam means comprising: a cam follower connected to the mechanical actuating means, and a cam rotatable about an axis and engaging the cam follower for moving the valve through the cam follower and the mechanical actuating means; the cam follower having a rounded contact surface having a crest which is closer to the cam axis than an adjacent portion of the contact surface, the cam having a profile defined by a base circle and a lift profile, and having a line of contact with the cam follower along a path aligned with the crest during portions of base circle contact adjacent the lift profile and offset from the crest during contact with a portion of the base circle opposite the lift profile whereby, due to the shape of the rounded contact surface, the initial portion of the offset part of the path allows unloading of the valve train and the final adjacent aligned path on the base circle effects slight compression of the valve train to compensate for lash and/or compliance.

BRIEF DESCRIPTION OF THE DRAWINGS

The above and other advantages of the invention will become more apparent from the following description taken in conjunction with the accompanying drawings wherein like references refer to like parts and wherein:

FIG. 2 is a cross-sectional view taken along line 2—2 of FIG. 1, FIG. 3 is a diagrammatic view of a cam and follower formed in accordance with the invention, FIG. 4 is an orthometric view of the cam according to the invention.

DESCRIPTION OF THE INVENTION

Figure 1:
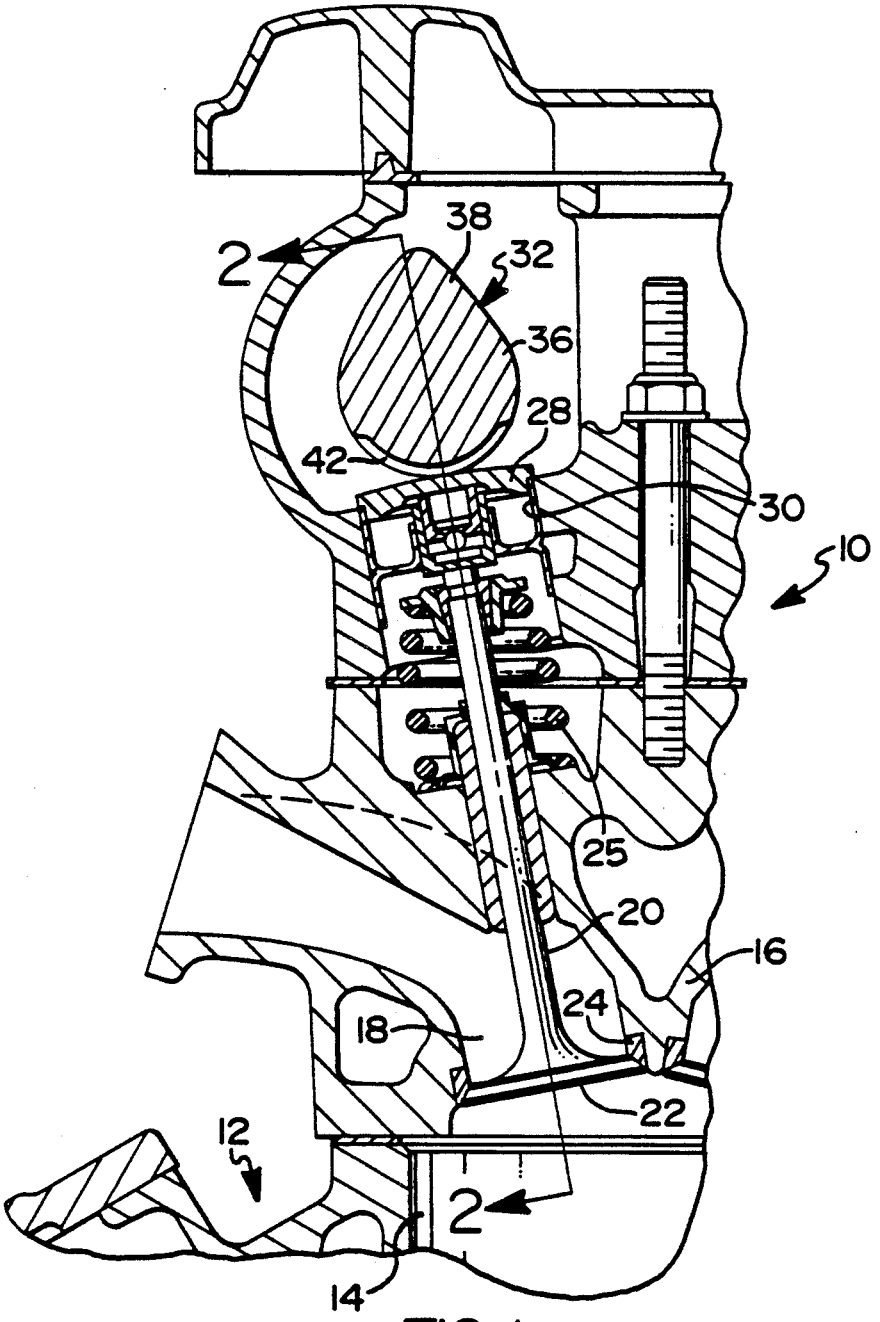
FIG. 1 is a fragmentary cross-sectional view of an internal combustion engine having a direct acting type valve train including lash compensation mechanism according to the invention.

Referring to FIGS. 1 and 2, an internal combustion engine 10 has a cylinder block 12 containing a plurality of cylinders 14 (one shown) and fitted with a cylinder head 16. An intake or exhaust port 18 is controlled by a poppet valve 20 having a head 22 which is shown in the closed position and which closes against a valve seat 24 surrounding the port 18.

Each valve 20 is urged into its closed position with a predetermined seating force by a valve spring 25 and is openable through the periodic action of a valve train including a camshaft 26, and a cam follower and valve lifter 28 which is preferably of the hydraulic lash adjusting type. The valve lifter 28 is directly interposed between the camshaft 26 and the valve 20 and is mounted in a bore 30 in the head for reciprocating movement.

The camshaft 26 is rotatably mounted in the head in a conventional overhead cam configuration and comprises a plurality of lobes or cams 32 each engaging one valve lifter 28 for the purpose of actuating the valve train upon rotation of the camshaft. The camshaft 26 is driven by the crankshaft in predetermined phase relation therewith at a rotational speed proportional to the crankshaft speed. In each cycle, each cam 32 engages its cam follower or valve lifter 28, actuating the valve train for controlled opening and closing of the valve against the valve spring forces.

The valve lifter or cam follower 28, as best shown in FIG. 3, has a rounded or spherical crown 34 for bearing against the cam 32, the crest 35 or highest point of the crown being at the center. The radius of the crown may be of the order of 20 to 200 inches but is not limited to this range. This makes possible the extension of the follower if the cam contact is offset from the crest instead of on the crest. That is, the follower is adjusted to a height sufficient to contact the lowest part of the cam, and the height is greater if the follower contacts the cam at a point lower than the crest.

The cam 32, shown in FIGS. 3 and 4, has a base circle portion 36 and a lift profile 38 which protrudes above the base circle to provide opening movement of the valve. The base circle portion comprises a cylindrical surface 40 concentric with the rotation axis of the camshaft. The base circle portion 36 is modified by a relief 42 in the cam opposite the lift profile 38 which extends from one side of the cam to a region beyond the crest of the cam follower 28. In a cam having a width of one inch, the relief may extend one quarter inch beyond the crest, for example or three fourths of the width from the edge. The relief is a small amount, say, 1 mm, which is cast into the cam and conveniently has a fillet 43 which merges into the base circle cylindrical portion 40. As a result, when the relief portion 42 is aligned with the cam follower, the base circle portion 36 contacts the follower 28 at a point offset from the crest 35 by a distance O. This allows the follower 28 to assume a higher position (closer to the camshaft axis) by a distance P than when the base circle contacts the crest. The distance P is just sufficient to load the valve train enough to remove the lash due to clearances, if any, and effect compression of the valve train components when the cam contact moves from the relief to the base circle, and does not cause valve opening. The amount of offset O from the crest and the radius R of the follower 28 determine the compensation P by the formula $P=R-(R^2-O^2)^{\frac{1}{2}}$. Thus if R=50 inches and O=0.5 inch, P=0.0025 inch.

Figure 5:
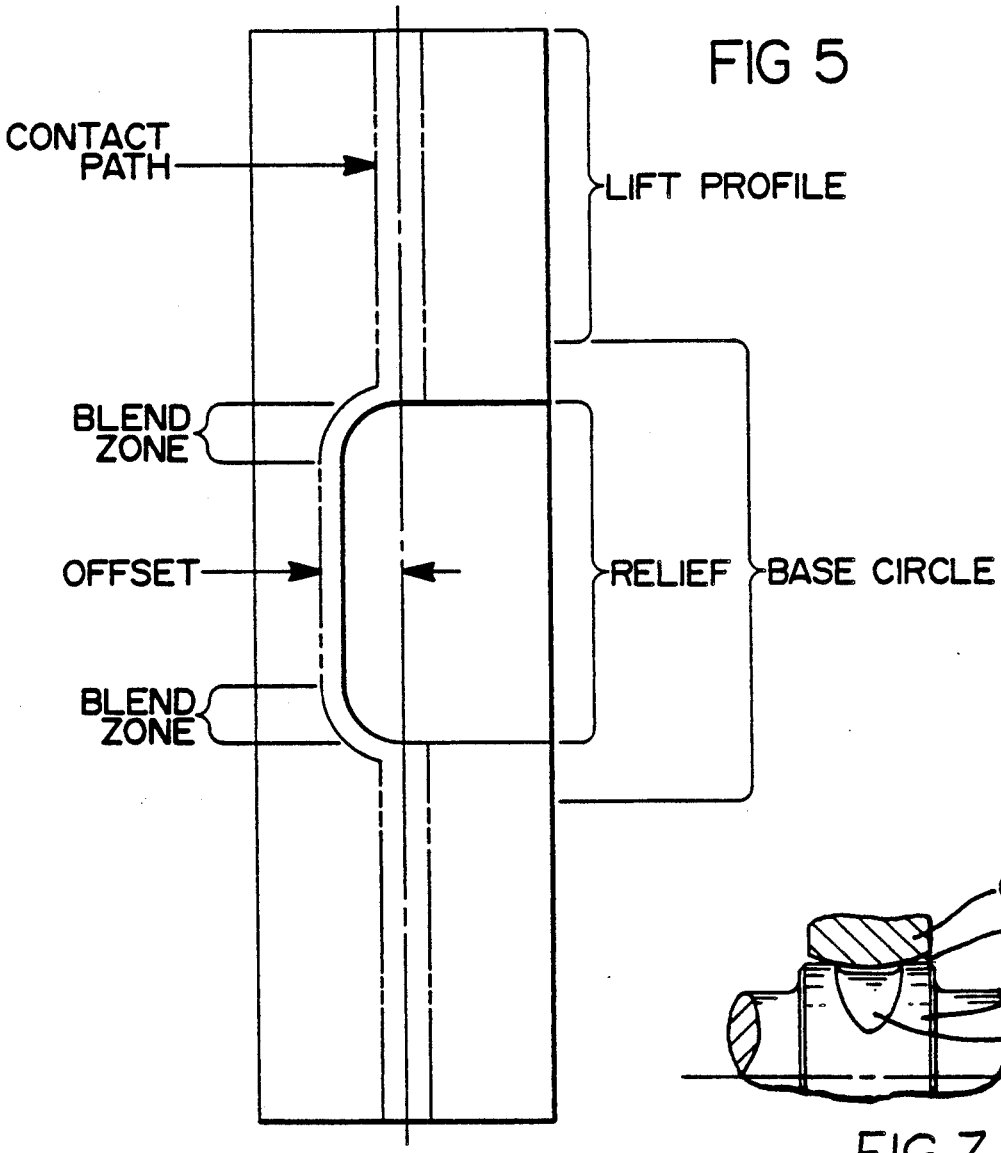
FIG. 5 is a developed view of the cam of the preceding figures illustrating the path of contact with the follower.

The ends of the relief portion 42 are curved to blend into the base circle to afford a smooth and/or variable rate of transition from the offset to the crest during cam rotation. The blend zone is shown in the illustration of FIG. 5 which is a development of the cam surface with the nose of the lift profile at either end and the relief portion in the center. The phantom lines define the path of contact of the cam 32 and the follower 28. Beginning at the top of the figure, the lift profile 38 makes contact with the crest of the follower so that the contact path is centered on the lobe along the lift ramp. The path remains centered over the true base circle portion, and at the beginning of the relief portion 42, a first blend zone allows the gradual shift of contact from the cam center to the offset line for controlled transition from unloaded to slightly compressed conditions of the valve train. The path continues symmetrically to the other ramp of the lift profile. Optionally, the second blend zone is shaped differently from the first blend zone to specially control the relaxation rate of the valve train.

It can thus be seen that when the cam contact with the follower 28 moves from the crest to the offset the follower is relieved of cam force and, in the case of a hydraulic adjustable lifter, the lifter expands to take up any clearance in the valve train. The follower does not, however, compensate for compliance in the valve train. When the cam contact moves through the blend zone to center contact with the base circle, the valve train is compressed by the compensation amount P to then take up the compliance. Thus it is important that the relief portion and the follower crown be designed to yield a value of P which is just enough to compensate for compliance. Of course, if the follower is not automatically adjusting there may be clearances between valve train elements which must first be removed, so in that case the value of P must be great enough to incorporate both lash and compliance compensation.

A benefit of the cam relief is that the sliding action of the cam at the offset location on the follower causes follower rotation to promote uniform wear on the follower. This feature is available wherever the follower is capable of such rotation. It is apparent, however, that followers which do not rotate can take advantage of the lash/compliance compensation feature. A roller type follower is an example of such an application.

Figure 6:
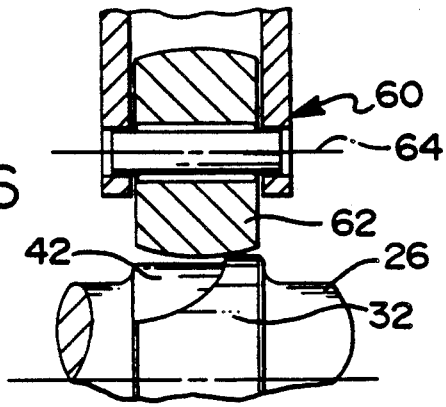
FIG. 6 is an elevational view of a cam and roller type follower according to another embodiment of the invention.

A roller type follower 60 is shown in FIG. 6 as another embodiment. There, a cam follower has a roller 62 which has an axis of rotation 64 parallel to the camshaft 26. The roller is crowned or barrel shaped and contacts a cam 32 with a relief portion 42 as described above. When the cam contact path reaches the offset it engages a portion of the curved roller which is lower than the crest of the roller to provide the lash/compliance compensation in the same manner as in the first embodiment. To assure the correct roller position, the follower must be held against rotation about the axis normal to the roller axis. Such a roller follower may be mounted on a lash adjuster or solid tappet, a rocker arm or a push rod, for example.

Figure 7:
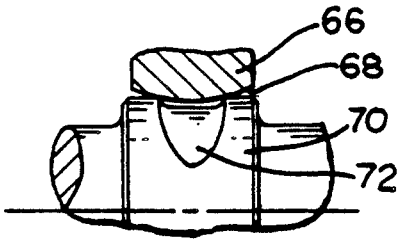
FIG. 7 is an elevational view of an alternative cam configuration with a curved surface follower shown in cross section.

FIG. 7 shows an alternative embodiment having a sliding follower shoe 66 with a curved contact surface 68 that is shaped in cross section like that of the roller 62 of FIG. 6 or the follower 28 of FIGS. 1 and 2. Thus, any of these follower embodiments could be used in place of the sliding shoe 66 which could, for example, form part of a rocker arm. The shoe 66 contacts a cam 70 which is similar to cams 32 except that the relief portion 72 extends laterally for equal distances on either side of the follower crown but short of the cam edge. In this way the follower contacts the cam on both sides of the relieved portion so that tilting forces on the follower are avoided and wear is minimized.

Figure 8:
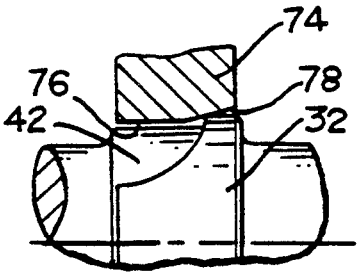
FIG. 8 is an elevational view of a cam similar to FIGS. 2 and 6 with another embodiment of follower having a shaped surface shown in cross section.

FIG. 8 illustrates another approach in which a cam 32 with a relief portion 42 like those of FIGS. 2 and 6. The cam 32 contacts a follower 74 having in cross section a flat crest portion 76 connected with an angular relief 78 on one side of the follower. The crest portion 76 is parallel to the cam surface for engagement therewith. The relief 78 could be straight or curved as desired. This embodiment has the advantage for some forms of valve mechanisms that a larger engaging surface or contact path is created between the cam and the flat crest portion 76 of the follower during the high load valve opening and closing portions of cam rotation.

It will be apparent that since the cam relief is cast in the cam and no machining is required beyond the usual grinding and polishing of the cam contact surface, the special camshaft required for implementing the invention bears no extra cost compared to a standard camshaft design. Similarly, the crowned or shaped cam follower surface is easy and economical to make. Thus the advantages of a low noise valve train can be realized in a practical production design. In addition, the lifter rotation feature is available at no further cost.

The invention is primarily intended for a valve train having a hydraulic lash adjuster so that only compliance is compensated for. As is apparent from the description, its application can be extended to systems having no automatic lash adjustment and thus used to remove small amounts of lash as well as compliance. The mechanism is herein described as a compensation mechanism applied to a direct acting overhead cam coupled to a valve through a hydraulic lash adjuster.

This is an exemplary embodiment only since the invention can be advantageously incorporated in other valve train systems. Overhead valve (push rod), L-head and in head arrangements could be used as well with the lash and compliance compensation mechanism. It can be adapted for cam to rocker arrangements if the rocker surface engaged by the cam is shaped properly. Certain examples of these variations are shown.

The embodiments of the invention in which an exclusive property or privilege is claimed are defined as follows:

1. A valve train for an internal combustion engine, said valve train comprising;

a poppet valve reciprocably movable to open and closed positions, a valve spring urging the valve toward its closed position with a predetermined seating force, a rotatable cam for causing controlled opening and closing of the valve against the force of the valve spring, actuator means operable by the cam for activating the valve, the actuator means including a cam follower having a crowned surface in contact with the cam, the crowned surface including a crest, and the cam having a lift profile operative to open and close the valve as it passes over the cam follower, a base circle portion shaped to contact the crest of the crowned surface in first regions adjacent the lift profile and to contact the crowned surface at a distance offset from the crest in a second region opposite the lift profile, the base circle portion being operative to compress the actuator means to near the point of valve opening when the base circle contacts the crest and to unload the actuator means when the base circle contacts the crowned surface at a distance offset from the crest.

2. The invention as defined in claim 1 wherein the base circle portion of the cam is a cylindrical surface modified in the second region by a relief portion in the part of the cam that is aligned with the crest of the crown to prevent contact of the second region of the base circle with the crest of the crowned surface.

3. The invention as defined in claim 1 wherein the base circle portion of the cam is a cylindrical surface modified in the second region by a relief portion in one side of the cam and extending beyond the crest of the crown to prevent contact of the second region of the base circle with the crest of the crowned surface.

4. The invention as defined in claim 1 wherein the cam follower is a hydraulic lash adjuster and the crowned surface has a spherical curvature.

5. The invention as defined in claim 1 wherein the cam follower is a roller mounted for rolling contact with the cam, and the roller having a crowned surface defining a crest.

6. In a valve train for an internal combustion engine, the valve train including a poppet valve reciprocably movable to open and closed positions and a valve spring urging the valve toward its closed position, cam means for controllably moving the valve between open and closed positions and mechanical actuating means coupling the cam means and the valve, the cam means comprising:

a cam follower connected to the mechanical actuating means, and a cam rotatable about an axis and engaging the cam follower for moving the valve through the cam follower and the mechanical actuating means;

the cam follower having a rounded contact surface defining a crest which is closer to the cam axis than an adjacent portion of the contact surface, the cam having a profile defined by a base circle and a lift profile, and having a line of contact with the cam follower along a path aligned with the crest during portions of base circle contact adjacent the lift profile and offset from the crest during contact with a portion of the base circle opposite the lift profile, whereby, due to the shape of the rounded contact surface, the offset part of the path allows unloading of the valve train and the adjacent aligned path on the base circle effects slight compression of the valve train prior to lift profile engagement with the follower.

7. The invention as defined in claim 6 wherein the curvature of the rounded contact surface and the amount of path offset determine the amount of follower movement as the cam contact point traverses between the crest and the offset.

8. The invention as defined in claim 6 wherein the aligned portion of the path gradually blends with the offset portion of the path for controlled transition between unloaded and slightly compressed conditions of the valve train.

9. The invention as defined in claim 1 wherein the base circle portion of the cam is a cylindrical surface modified in the second region by a relief portion extending on either side of the crest of the crown to prevent contact of the second region of the base circle with the crest of the crowned surface.

10. In a valve train for an internal combustion engine, the valve train including a poppet valve reciprocably movable to open and closed positions and a valve spring urging the valve toward its closed position, cam means for controllably moving the valve between open and closed positions and mechanical actuating means coupling the cam means and the valve, the cam means comprising:

a cam follower connected to the mechanical actuating means, and a cam rotatable about an axis and engaging the cam follower for moving the valve through the cam follower and the mechanical actuating means;

the cam follower having a shaped contact surface defining a crest which is closer to the cam axis than an adjacent portion of the contact surface, the cam having a profile defined by a base circle and a lift profile, and having a line of contact with the cam follower along a path aligned with the crest during portions of base circle contact adjacent the lift profile and offset from the crest during contact with a portion of the base circle opposite the lift profile, whereby, due to the shape of the contact surface, the offset part of the path allows unloading of the valve train and the adjacent aligned path on the base circle effects slight compression of the valve train prior to lift profile engagement with the follower.

11. The invention as defined in claim 10 wherein the crest of the contact surface is essentially flat in composition and extends to one edge of the contact surface and the cam contacts virtually the entire flat follower surface except during contact with said portion of the base circle opposite the lift profile.

12. The invention as defined in claim 11 wherein the adjacent portion of the follower contact surface comprises angular relief from the crest.

* * * * *